US009996022B2

(12) United States Patent
Todokoro

(10) Patent No.: US 9,996,022 B2
(45) Date of Patent: Jun. 12, 2018

(54) OPTICAL SCANNING DEVICE AND IMAGE FORMING APPARATUS

(71) Applicant: KYOCERA Document Solutions Inc., Osaka (JP)

(72) Inventor: Ryotaro Todokoro, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days. days.

(21) Appl. No.: 15/718,558

(22) Filed: Sep. 28, 2017

(65) Prior Publication Data

US 2018/0095379 A1 Apr. 5, 2018

(30) Foreign Application Priority Data

Sep. 30, 2016 (JP) ..... 2016-194460

(51) Int. Cl.
*G03G 15/00* (2006.01)
*G03G 15/04* (2006.01)

(52) U.S. Cl.
CPC ... *G03G 15/0409* (2013.01); *G03G 15/04036* (2013.01)

(58) Field of Classification Search
CPC ..... G02B 26/10; G03G 15/04036; G03G 15/0409; G03G 15/0435
See application file for complete search history.

(56) References Cited

U.S. PATENT DOCUMENTS 9,782,980 B2 * 10/2017 Yoshida ..... B41J 2/44
2006/0132880 A1 6/2006 Amada et al.
2011/0292156 A1 * 12/2011 Ooi ..... G02B 26/123 347/224
2016/0274485 A1 * 9/2016 Masaki ..... B41J 2/44

* cited by examiner

*Primary Examiner* — Hoang Ngo
(74) *Attorney, Agent, or Firm* — Wenderoth, Lind & Ponack, L.L.P.

(57) ABSTRACT

An adjustment method of an optical scanning device, in which an uppermost position at an incident surface of the image forming lens, through which a light beam being deflected and scanned passes, and a lowermost position at the incident surface of the image forming lens, through which a light beam being deflected and scanned passes, are detected in a height direction perpendicular to the main scanning direction in an effective range corresponding to a latent image formation target range on the scanning target surface, and a center height between the uppermost position and the lowermost position is allowed to approximately coincide with a height of a bus line of the image forming lens at the incident surface of the image forming lens.

11 Claims, 7 Drawing Sheets

OPTICAL SCANNING DEVICE AND IMAGE FORMING APPARATUS

CROSS-REFERENCE TO RELATED APPLICATION

This application is based upon and claims the benefit of priority from Japanese Patent Application No. 2016-194460 filed on Sep. 30, 2016, the entire contents of which are incorporated herein by reference.

BACKGROUND

The technology of the present disclosure relates to an optical scanning device and an image forming apparatus including the same.

In the related art, there has been known an optical scanning device installed at an electrophotographic image forming apparatus and the like for example. This optical scanning device has a polygon mirror that deflects and scans a light beam emitted from a light source and a scanning lens that forms an image of the light beam deflected and scanned by the polygon mirror on a scanning target surface. In this optical scanning device, a problem, such as scanning line bending occurring when the shape of the scanning lens deviates from an ideal shape, is solved by pressing the scanning lens by using a plurality of elastic members to correct the scanning line bending and the like.

SUMMARY

An adjustment method of an optical scanning device according to one aspect of the present disclosure is a method for adjusting the optical scanning device including a deflection unit that deflects and scans a light beam emitted from a light source in a main scanning direction and an image forming lens that extends along the main scanning direction and forms an image of the light beam deflected and scanned by the deflection unit on a scanning target surface.

Furthermore, in the adjustment method of the optical scanning device, an uppermost position at an incident surface of the image forming lens, through which a light beam being deflected and scanned passes, and a lowermost position at the incident surface of the image forming lens, through which a light beam being deflected and scanned passes, are detected in a height direction perpendicular to the main scanning direction in an effective range corresponding to a latent image formation target range on the scanning target surface, and a center height between the uppermost position and the lowermost position is allowed to approximately coincide with a height of a bus line of the image forming lens at the incident surface of the image forming lens.

Furthermore, an optical scanning device according to another aspect of the present disclosure includes a deflection unit and an image forming lens. The deflection unit deflects and scans a light beam emitted from a light source in a main scanning direction. The image forming lens extends along the main scanning direction and forms an image of the light beam deflected and scanned by the deflection unit on a scanning target surface.

Furthermore, a center height between an uppermost position at an incident surface of the image forming lens, through which a light beam being deflected and scanned passes, and a lowermost position at the incident surface of the image forming lens, through which a light beam being deflected and scanned passes, is allowed to approximately coincide with a height of a bus line of the image forming lens in a height direction perpendicular to the main scanning direction in an effective range corresponding to a latent image formation target range on the scanning target surface.

An image forming apparatus according to another aspect of the present disclosure includes the aforementioned optical scanning device.

DETAILED DESCRIPTION

Hereinafter, an example of an embodiment will be described in detail on the basis of the drawings. It is noted that the technology of the present disclosure is not limited to the following embodiments.

Embodiment 1

Figure 1:
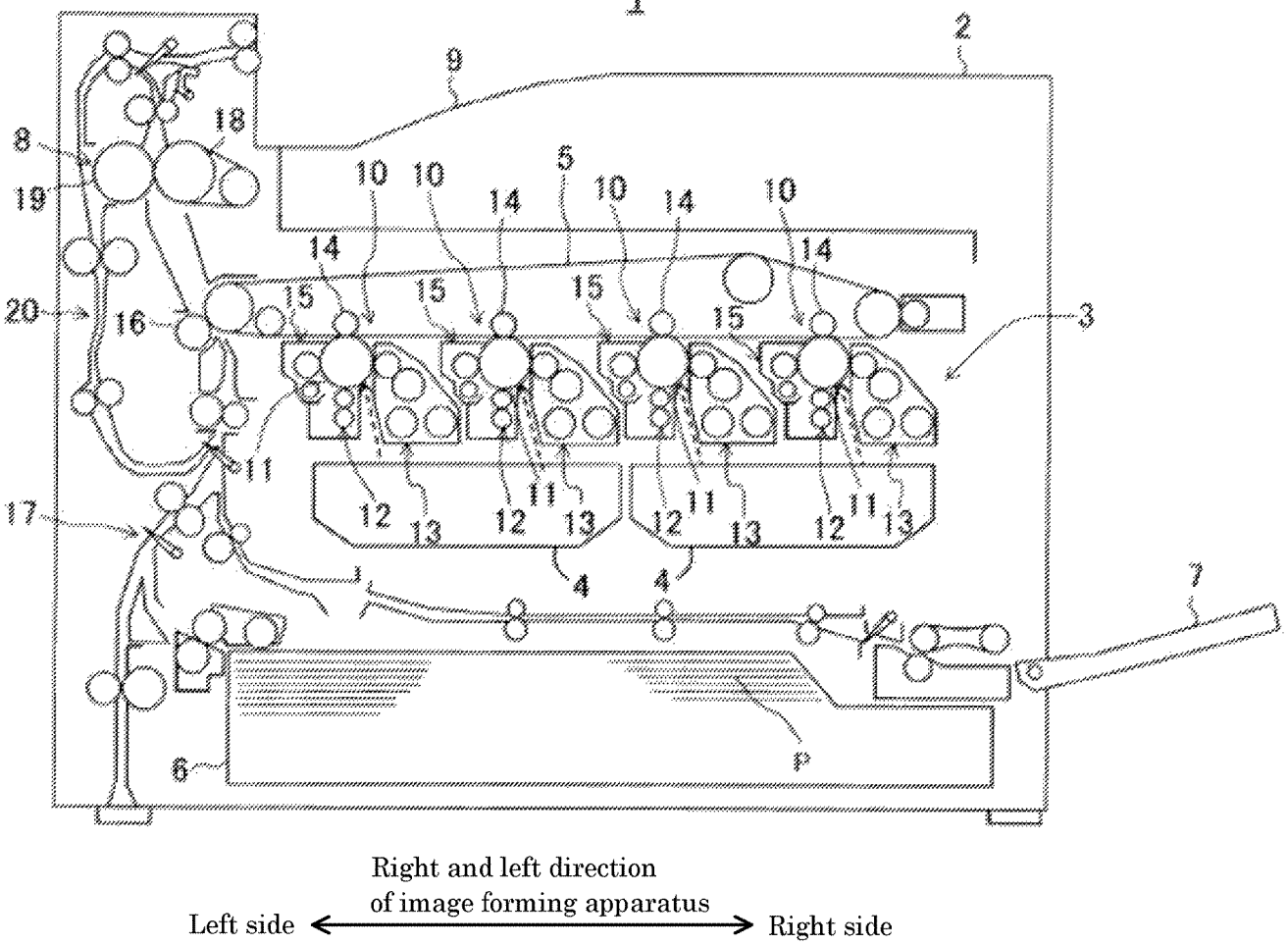
FIG. 1 is a schematic configuration diagram illustrating an image forming apparatus in an embodiment.

FIG. 1 illustrates a schematic configuration diagram of an image forming apparatus 1 in an embodiment. This image forming apparatus 1 is a tandem type color printer and includes an image forming unit 3 in a box-like casing 2. The image forming unit 3 is an element that transfers an image to a recording sheet P and forms the image on the recording sheet P on the basis of image data. The image data, for example, is transmitted from an external device such as a computer subjected to network connection and the like. Below the image forming unit 3, an optical scanning device 4 is arranged to irradiate a light beam (a laser light), and above the image forming unit 3, a transfer belt 5 is arranged. Below the optical scanning device 4, a sheet storage unit 6 is arranged to store the recording sheet P, and at a lateral side of the sheet storage unit 6, a manual sheet feeding unit 7 is arranged. On a lateral upper side of the transfer belt 5, a fixing unit 8 is arranged to perform a fixing process on the recording sheet P with the image transferred and formed. A sheet discharge unit 9 is arranged at an upper portion of the casing 2 to discharge the recording sheet P subjected to the fixing process in the fixing unit 8.

The image forming unit 3 includes four image forming units 10 arranged in a row along the transfer belt 5. Each of the image forming units 10 has a photosensitive drum 11. Directly under each photosensitive drum 11, a charging device 12 is arranged, and at one lateral side of each photosensitive drum 11, a developing device 13 is arranged. Directly above each photosensitive drum 11, a primary transfer roller 14 is arranged, and at the other lateral side of each photosensitive drum 11, a cleaning unit 15 is arranged to clean a peripheral surface of each photosensitive drum 11. In addition, as illustrated in FIG. 1, the image forming apparatus 1 is provided with two optical scanning devices 4 that deflect and scan two light beams. As the two optical scanning devices 4, the same optical scanning device is used.

The peripheral surface of each photosensitive drum 11 is uniformly charged by the charging device 12, and a laser light corresponding to each color based on the image data is irradiated to the charged peripheral surface of each photosensitive drum 11 from each optical scanning device 4, so that an electrostatic latent image is formed on the peripheral surface of each photosensitive drum 11. A developer is supplied to the electrostatic latent image from the developing device 13, so that a yellow, magenta, cyan, or black toner image is formed on the peripheral surface of each photosensitive drum 11. These toner images are respectively superposed on and transferred to the transfer belts 5 by a transfer bias applied to the primary transfer roller 14.

In the image forming apparatus 1, a secondary transfer roller 16 is arranged below the fixing unit 8 in the state of abutting the transfer belt 5. The recording sheet P conveyed along a sheet conveyance path 17 from the sheet storage unit 6 or the manual sheet feeding unit 7 is interposed between the secondary transfer roller 16 and the transfer belt 5, and the toner images on the transfer belt 5 are transferred to the recording sheet P by a transfer bias applied to the secondary transfer roller 16.

The fixing unit 8 includes a heating roller 18 and a pressure roller 19, wherein the recording sheet P is interposed by the heating roller 18 and the pressure roller 19 so as to be heated and pressed, so that the toner images, which have been transferred to the recording sheet P, are fixed to the recording sheet P. The recording sheet P subjected to the fixing process is discharged to the sheet discharge unit 9. The image forming apparatus 1 is provided with a reversing conveyance path 20 for reversing the recording sheet P discharged from the fixing unit 8 at the time of duplex printing.

—For Configuration of Optical Scanning Device—

Figure 2:
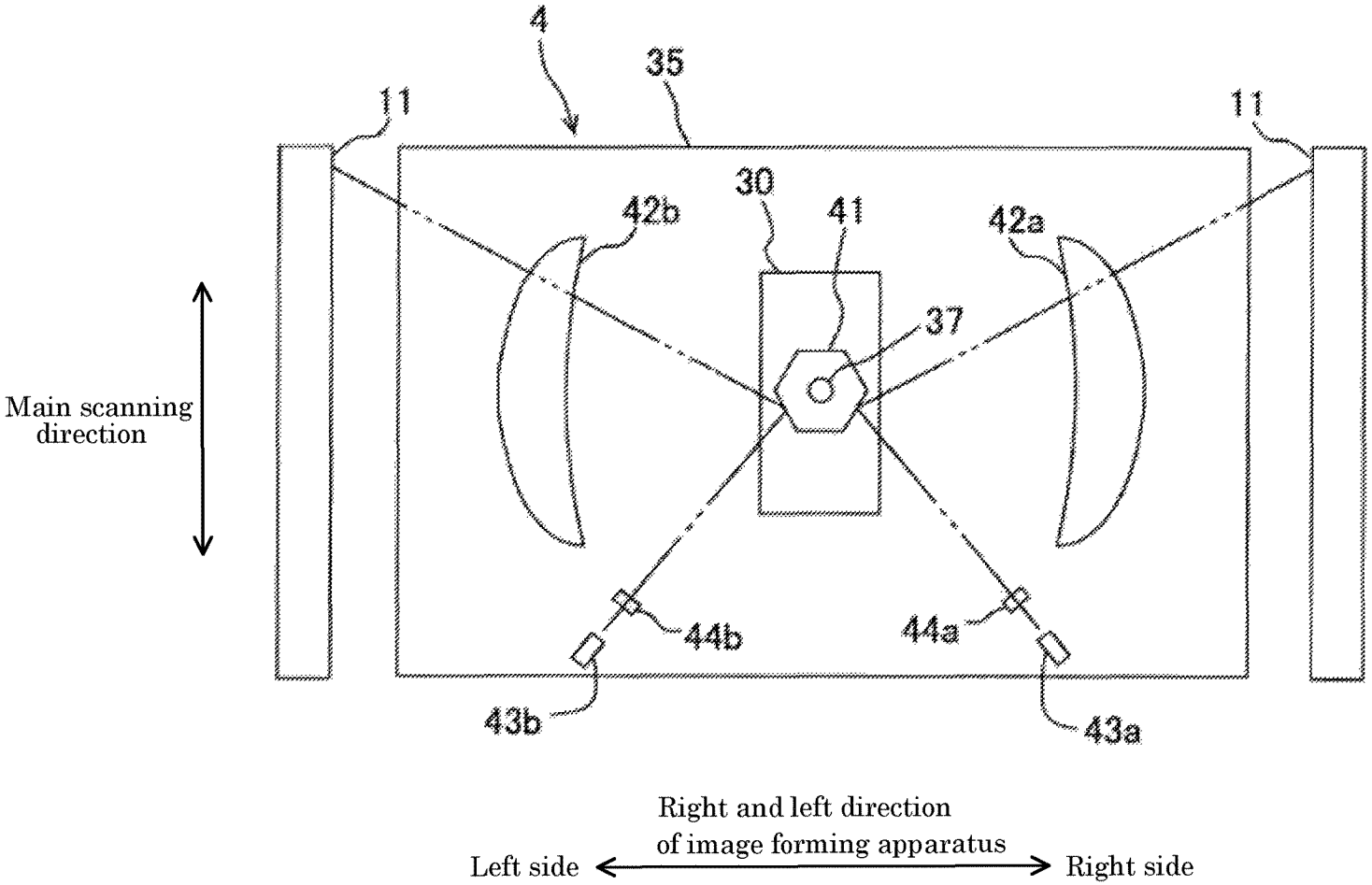
FIG. 2 is a schematic plan view illustrating an optical scanning device.
Figure 3:
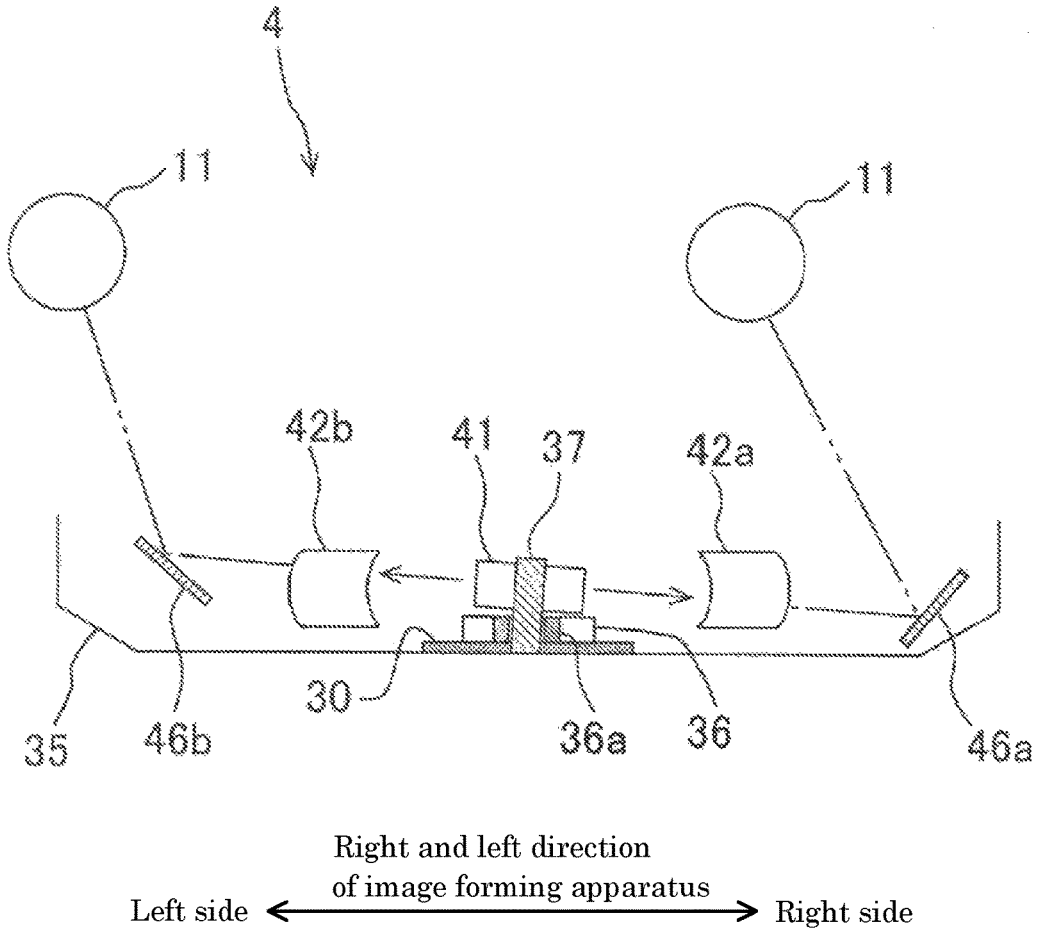
FIG. 3 is a view schematically illustrating a section obtained by cutting an optical scanning device in a right and left direction.

Next, details of the optical scanning device 4 will be described. FIG. 2 is a plan view illustrating an internal structure of the optical scanning device 4 and FIG. 3 is a view schematically illustrating a section obtained by cutting the optical scanning device 4 in a right and left direction (an arrangement direction of the photosensitive drums 11). FIG. 2 illustrates a pair of photosensitive drums 11 arranged outside a pair of image forming lenses 42*a* and 42*b* for the purpose of convenience.

In the optical scanning device 4, the pair of image forming lenses 42*a* and 42*b* are configured in an opposed scanning type in which they face each other while interposing a polygon mirror 41 therebetween. Specifically, the optical scanning device 4 includes a pair of light source units 43*a* and 43*b*, the polygon mirror 41 that deflects and scans light beams, which are emitted from the light source units 43*a* and 43*b*, in a main scanning direction, and the pair of image forming lenses 42*a* and 42*b* extending along the main scanning direction. These components of the optical scanning device 4 are received in a housing 35. An upper side of the housing 35 is closed by a lid member (not illustrated) formed with slits that allow the light beams to pass therethrough.

The polygon mirror 41 is a rotating polygon mirror formed in a regular hexagonal columnar shape and having six reflective surfaces at a side surface thereof, and constitutes a deflection unit. The polygon mirror 41 is connected to a driving shaft 37 of a polygon motor 36. The polygon mirror 41 is rotationally driven by the polygon motor 36 at a predetermined speed, thereby reflecting the light beams emitted from the light source units 43*a* and 43*b* and deflecting and scanning the light beams in the main scanning direction.

The polygon mirror 41 is mounted at an approximate rectangular board 30 via the driving shaft 37. As illustrated in FIG. 2, the board 30 is fixed at a center portion of a bottom surface of the housing 35 such that its longitudinal direction is approximately parallel to the photosensitive drum 11 (the scanning target surface). Four photosensitive drums 11 are provided approximately in parallel to one another. The polygon mirror 41 is mounted at an approximate center in a short direction of the board 30. That is, in the plan view, distances from the long sides of the board 30 to the center of the polygon mirror 41 are equal to each other. In addition, the polygon mirror 41 is inclined and its center position is a position at the center in the height direction thereof. This point is also similar in the following description.

In the present embodiment, a bearing part 36*a* of the polygon motor 36 is formed such that the driving shaft 37 is inclined with respect to the board 30. The driving shaft 37 is inclined to one side of the pair of image forming lenses 42*a* and 42*b* in the short direction of the board 30. In addition, the board 30 is inclinedly installed, so that the driving shaft 37 may be inclined to one side of the pair of image forming lenses 42*a* and 42*b* in the short direction of the board 30. In this case, for example, at one side in the short direction of the board 30, a member is inserted between the board 30 and the bottom surface of the housing 35.

The pair of image forming lenses 42*a* and 42*b* are long optical elements that form the images of the light beams deflected and scanned by the polygon mirror 41 on the surfaces of the photosensitive drums 11. In the plan view, each of the pair of image forming lenses 42*a* and 42*b* is configured by an fθlens in which its center portion in the main scanning direction swells to a side opposite to the polygon mirror 41 side, and is bent along a virtual arc in which the polygon mirror 41 is employed as a center.

Furthermore, in a transverse sectional view, the center portion of each of the image forming lenses 42*a* and 42*b* in a height direction (an up and down direction in FIG. 3) perpendicular to the main scanning direction swells to a side opposite to the polygon mirror 41 side. Each image forming lens 42 is supported onto the bottom surface of the housing 35 via a support member (not illustrated) such that its height becomes constant in the main scanning direction.

In the plan view, the pair of image forming lenses 42*a* and 42*b* are bilaterally symmetrically arranged with the polygon mirror 41 as a center. Distances from the center of the polygon mirror 41 to the centers of the image forming lenses 42*a* and 42*b* are equal to each other. In addition, the centers of the image forming lenses 42*a* and 42*b* are centers on bus lines 52*a* and 52*b* in the main scanning direction. In the transverse sectional view, the bus lines 52*a* and 52*b* are lines passing through height positions (center positions in the height direction) at which the outer surfaces of the image forming lenses 42*a* and 42*b* are most swollen, and extend at the height positions in the main scanning direction. Hereinafter, between the pair of image forming lenses 42*a* and 42*b*, the right one is called a "first image forming lens 42*a*" and the left one is called a "second image forming lens 42*b*".

The pair of light source units 43*a* and 43*b* are bilaterally symmetrically (specifically, are in line symmetry with respect to a center line in the longitudinal direction of the board 30) arranged on the bottom surface of the housing 35. Hereinafter, between the pair of light source units 43*a* and 43*b*, the right one is called a "first light source unit 43*a*" and the left one is called a "second light source unit 43*b*". Each of the light source units 43*a* and 43*b* is configured by a laser light source.

Between the polygon mirror 41 and the first light source unit 43*a*, a first collimator lens 44*a*, an aperture (not illustrated), and a cylindrical lens (not illustrated) are arranged sequentially from the first light source unit 43*a* side. Between the polygon mirror 41 and the second light source unit 43*b*, a second collimator lens 44*b*, an aperture (not illustrated), and a cylindrical lens (not illustrated) are arranged sequentially from the second light source unit 43*b* side.

At the time of the operation of the optical scanning device 4, light beams emitted from the light source units 43*a* and 43*b* are deflected and scanned by the polygon mirror 41, and then pass through the image forming lenses 42*a* and 42*b* as illustrated in FIG. 3. Thereafter, the light beams are reflected by reflection mirrors 46*a* and 46*b* and the images of the light beams are respectively formed on the photosensitive drums 11. The surfaces of the photosensitive drums 11 respectively constitute scanning target surfaces of the light beams. In addition, in the present embodiment, the number of the image forming lenses 42*a* and 42*b* arranged on an optical path between the polygon mirror 41 and the scanning target surfaces is 1, respectively.

—For Adjustment Method of Optical Scanning Device—

An adjustment method of the optical scanning device 4 will be described. In the adjustment method of the optical scanning device 4, an adjustment step is performed to adjust the heights of scanning lines 62*a* and 62*b* on incident surfaces 51*a* and 51*b* of the image forming lenses 42*a* and 42*b*. The adjustment step, for example, is performed after the optical scanning device 4 is assembled. The adjustment step constitutes a part of a manufacturing method of the optical scanning device 4.

Figure 4:
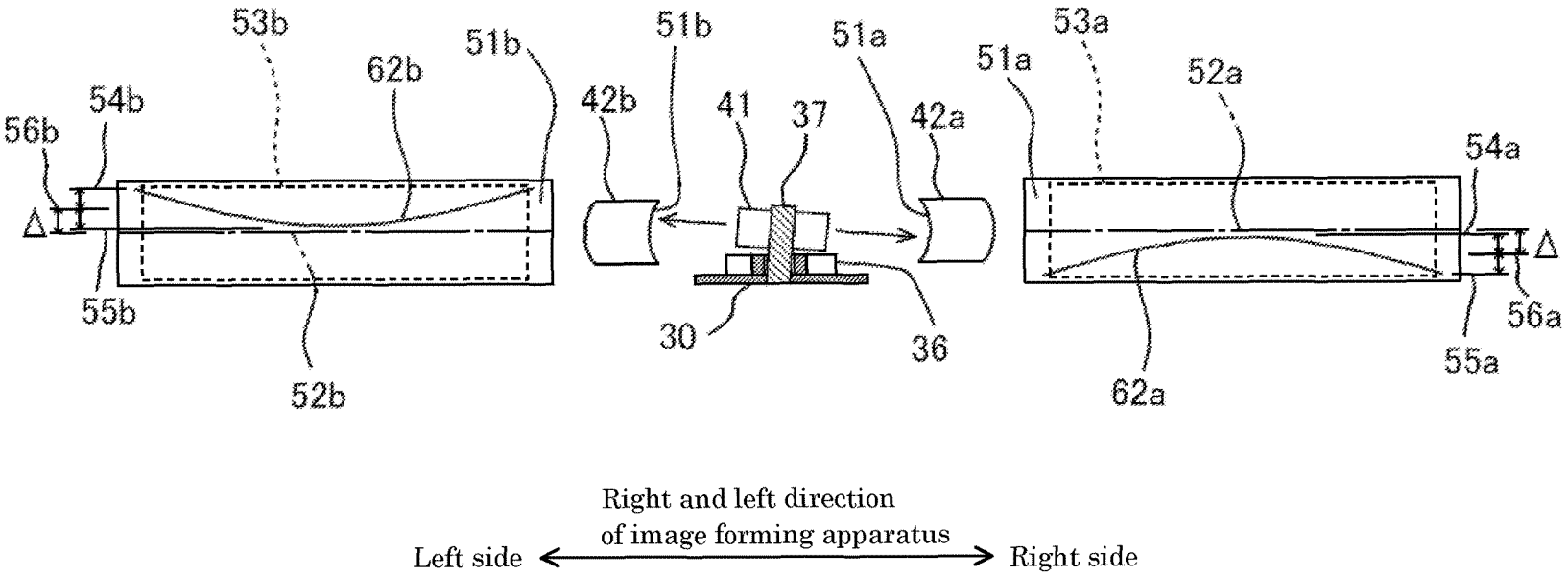
FIG. 4 is a view illustrating scanning lines of light beams on incident surfaces of image forming lenses before an adjustment step is performed.
Figure 5:
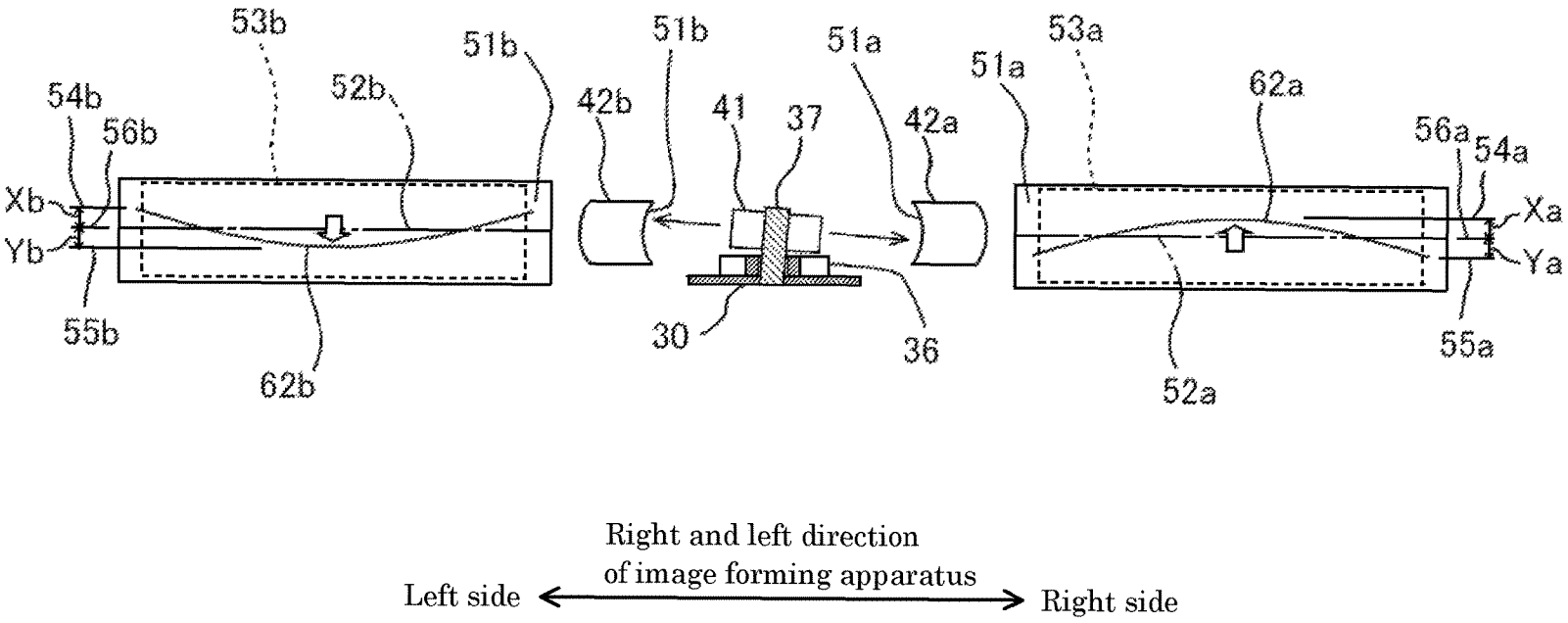
FIG. 5 is a view illustrating scanning lines of light beams on incident surfaces of image forming lenses after an adjustment step is performed.

FIG. 4 illustrates the scanning lines 62*a* and 62*b* of light beams on the incident surfaces 51*a* and 51*b* of the image forming lenses 42*a* and 42*b* before the adjustment step is performed. FIG. 5 illustrates the scanning lines 62*a* and 62*b* of the light beams on the incident surfaces of the image forming lenses 42*a* and 42*b* after the adjustment step is performed.

Firstly, a state before performing the adjustment step will be described. The first image forming lens 42*a* and the second image forming lens 42*b* are installed at the same height, the first light source unit 43*a* and the second light source unit 43*b* are also installed at the same height, and the first collimator lens 44*a* and the second collimator lens 44*b* are also installed at the same height. As described above, the driving shaft 37 serving as a rotating shaft of the polygon mirror 41 is inclined to the first image forming lens 42*a* side in the short direction of the board 30.

In this state, the reflected light of the polygon mirror 41 is obliquely emitted downward at the right side of the polygon mirror 41 and is obliquely emitted upward at the left side of the polygon mirror 41. At the incident surfaces 51*a* and 51*b* of the image forming lenses 42*a* and 42*b*, the scanning lines 62*a* and 62*b* of the light beams are bent in a sub-scanning direction. Specifically, at the incident surface 51*a* of the image forming lens 42*a*, the scanning line 62*a* of the light beam is bent upward in a convex shape and at the incident surface 51*b* of the image forming lens 42*b*, the scanning line 62*b* of the light beam is bent downward in a concave shape. Moreover, at the incident surfaces 51*a* and 51*b* of the image forming lenses 42*a* and 42*b*, the scanning lines 62*a* and 62*b* are relatively largely deviated from the bus lines 52*a* and 52*b*.

When the scanning lines 62*a* and 62*b* of the light beams are bent at the incident surfaces 51*a* and 51*b* of the image forming lenses 42*a* and 42*b* in the sub-scanning direction, the heights of the passing light beams are different from each other by positions in the main scanning direction. Therefore, uniformity of light beam diameters on the surfaces of the photosensitive drums 11 in the main scanning direction is broken. Moreover, in the state in which the scanning lines 62*a* and 62*b* are relatively largely deviated from the bus lines 52*a* and 52*b* at the incident surfaces 51*a* and 51*b* of the image forming lenses 42*a* and 42*b*, the aforementioned uniformity of the light beam diameters is largely broken. Therefore, image quality of the image forming apparatus 1 may be degraded.

Specifically, since the scanning lines 62*a* and 62*b* pass through the vicinity of the bus lines 52*a* and 52*b* at a center portion of an image in the main scanning direction, it is possible to obtain sufficient optical characteristics. However, since the scanning lines 62*a* and 62*b* pass through positions separated from the bus lines 52*a* and 52*b* at an end portion of the image in the main scanning direction, it is not possible to obtain sufficient optical characteristics. As a consequence, since a large difference occurs in optical characteristics in an entire image area, a problem such as image density unevenness may occur.

In the present embodiment, in order to solve such a problem, the adjustment step is performed to adjust the heights of the scanning lines 62*a* and 62*b* on the incident surfaces 51*a* and 51*b* of the image forming lenses 42*a* and 42*b*. In order to adjust the heights of the light beams on the incident surfaces 51*a* and 51*b*, at least one of adjustment of the heights of the image forming lenses 42*a* and 42*b*, adjustment of the heights of the light source units 43*a* and 43*b*, and adjustment of the heights of the first and second collimator lenses 44*a* and 44*b* is performed.

Specifically, in the adjustment step, the uppermost position (a height position of an extension line 54*a*) at the incident surface 51*a* of the first image forming lens 42*a*, through which the light beam being deflected and scanned passes, and the lowermost position (a height position of an extension line 55*a*) at the incident surface 51*a* of the first image forming lens 42*a*, through which the light beam being deflected and scanned passes, are detected in the height direction in an effective range 53*a* corresponding to a latent image formation target range (an image printing area) of the surface of the photosensitive drum 11, and a deviation amount Δ of a center height (a height position of an extension line 56*a*) between the uppermost position and the lowermost position with respect to the height of the bus line 52*a* is further detected. The uppermost position and the lowermost position, for example, are detected by analyzing an image obtained by capturing the incident surface 51*a* of the first image forming lens 42*a* by using a camera.

Furthermore, the first image forming lens 42*a* is allowed to move downward by the deviation amount Δ, thereby allowing the center height between the uppermost position and the lowermost position to approximately coincide with the height of the bus line 52*a* of the first image forming lens 42*a* at the incident surface 51*a* of the first image forming lens 42*a*. In a dimension illustrated in FIG. 5, the height of the first image forming lens 42*a* is adjusted such that Xa becomes equal to Ya. In addition, the height of the first light source unit 43*a* or the first collimator lens 44*a* may be adjusted.

Furthermore, in the adjustment of the height of the scanning line 62*b* at the incident surface 51*b* of the second image forming lens 42*b*, the deviation amount Δ detected for the first image forming lens 42*a* is used. Specifically, the second image forming lens 42*b* is allowed to move upward by the deviation amount Δ, thereby allowing a center height (a height position of an extension line 56*b*) between the uppermost position (a height position of an extension line 54*b*) and the lowermost position (a height position of an extension line 55*b*) to approximately coincide with the height of the bus line 52*b* of the second image forming lens 42*b* at the incident surface 51*b* of the second image forming lens 42*b*. In the dimension illustrated in FIG. 5, the height of the second image forming lens 42*b* is adjusted such that Xb becomes equal to Yb. In addition, the height of the second light source unit 43*b* or the second collimator lens 44*b* may be adjusted.

For example, before the adjustment step, when a center height (a height at an axis center) of the polygon mirror 41 is defined as a "reference installation height" and the image forming lenses 42*a* and 42*b* are installed such that their center heights coincide with the reference installation height, differences between the center heights of the image forming lenses 42*a* and 42*b* and the reference installation height become equal to each other after the adjustment step. In addition, even when the light source units 43*a* and 43*b* or the collimator lenses 44*a* and 44*b* are employed as adjustment target parts and their heights are adjusted, when the adjustment target parts are installed such that their center heights coincide with the reference installation height before the adjustment step, differences between the center heights of the adjustment target parts and the reference installation height become equal to each other after the adjustment step.

Effects of Embodiment

In the present embodiment, the adjustment step is performed, thereby allowing the center height between the uppermost position and the lowermost position to approximately coincide with the heights of the bus lines 52*a* and 52*b* at the incident surfaces 51*a* and 51*b* of the image forming lenses 42*a* and 42*b*. Consequently, it is possible to improve non-uniformity of light beam diameters in an entire area of the surface of the photosensitive drum 11 in the main scanning direction without increasing parts to be used in the optical scanning device 4. Since it is possible to obtain averagely uniform beam performance throughout the whole scanning target surface, it is possible to suppress degradation of image quality of the image forming apparatus 1 due to scanning line bending.

Furthermore, in the present embodiment, the number of the image forming lenses 42*a* and 42*b* arranged on each optical path is 1, respectively. The degradation of image quality due to the scanning line bending can be reduced by providing a plurality of image forming lenses to each optical path. In the present embodiment, it is possible to suppress the degradation of image quality due to the scanning line bending without increasing the number of the image forming lenses 42*a* and 42*b*.

Furthermore, in the present embodiment, only for the first image forming lens 42*a* of the pair of image forming lenses 42*a* and 42*b*, the deviation amount Δ of the center height is detected with respect to the height of the bus line 52*a*, and at the respective incident surfaces 51*a* and 51*b* of the pair of image forming lenses 42*a* and 42*b*, the aforementioned center heights are mutually and reversely deviated by the deviation amount Δ, thereby allowing the center heights to approximately coincide with the heights of the bus lines 52*a* and 52*b*. According to the present embodiment, it is possible to save time and effort for detecting a deviation amount for the second image forming lens 42*b*, so that it is possible to reduce man-hour in the adjustment step.

Furthermore, in the present embodiment, since the distances from the center of the polygon mirror 41 to the centers of the image forming lenses 42*a* and 42*b* are equal to each other, an influence by the inclination of the driving shaft 37 is equal in the right and left. Moreover, since the approximately rectangular board 30 is provided such that the longitudinal direction is approximately parallel to a pair of scanning target surfaces corresponding to the pair of image forming lenses 42*a* and 42*b* and the polygon mirror 41 is mounted at an approximately center in the short direction of the board 30, the rotating shaft of the polygon mirror 41 easily falls down in the short direction of the board 30. From the above, in the height adjustment of the second image forming lens 42*b*, even though the deviation amount Δ detected for the first image forming lens 42*a* is used, it is possible to allow the center height to accurately coincide with the height of the bus line 52*b* at the incident surface 51*b* of the second image forming lens 42*b*.

Modification Example of Embodiment

Figure 6:
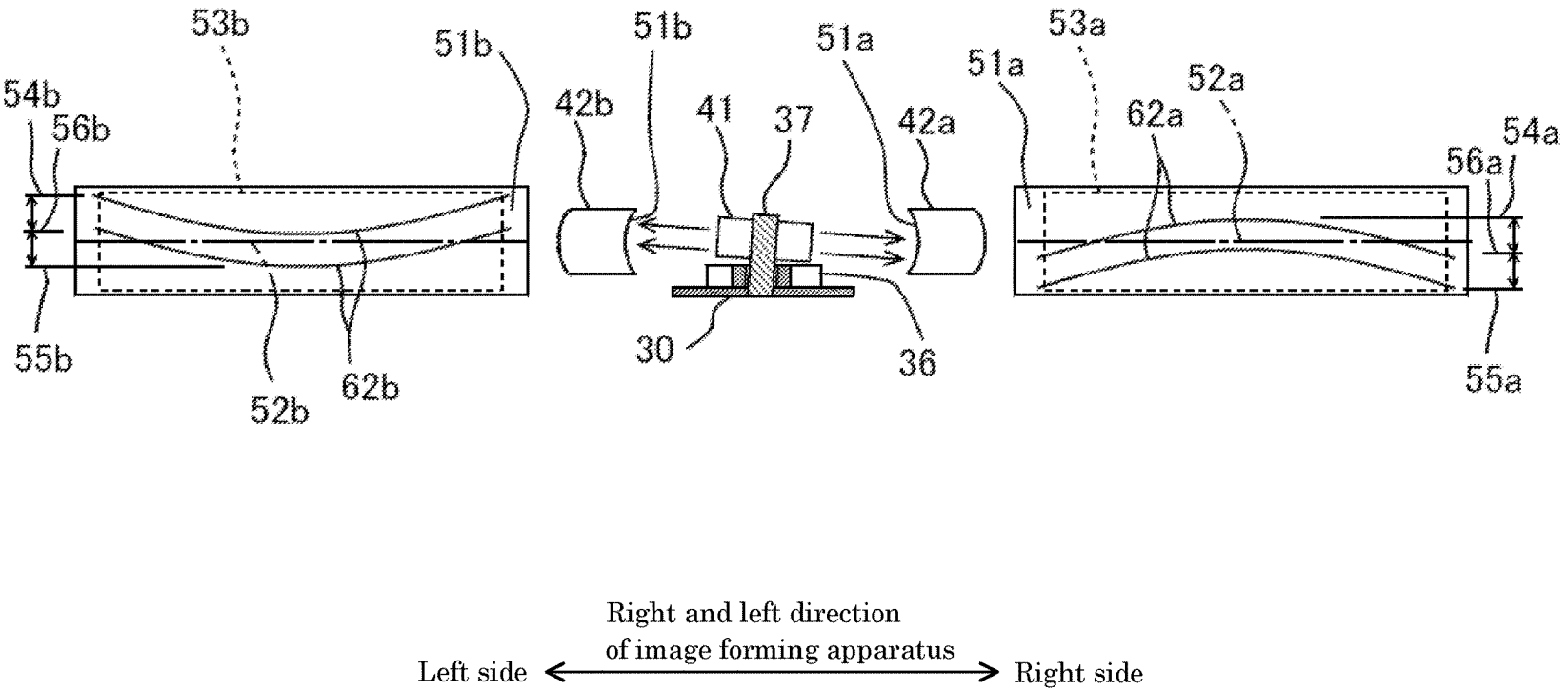
FIG. 6 is a view illustrating scanning lines of light beams on incident surfaces of image forming lenses before an adjustment step is performed in an optical scanning device according to a modification example of an embodiment.
Figure 7:
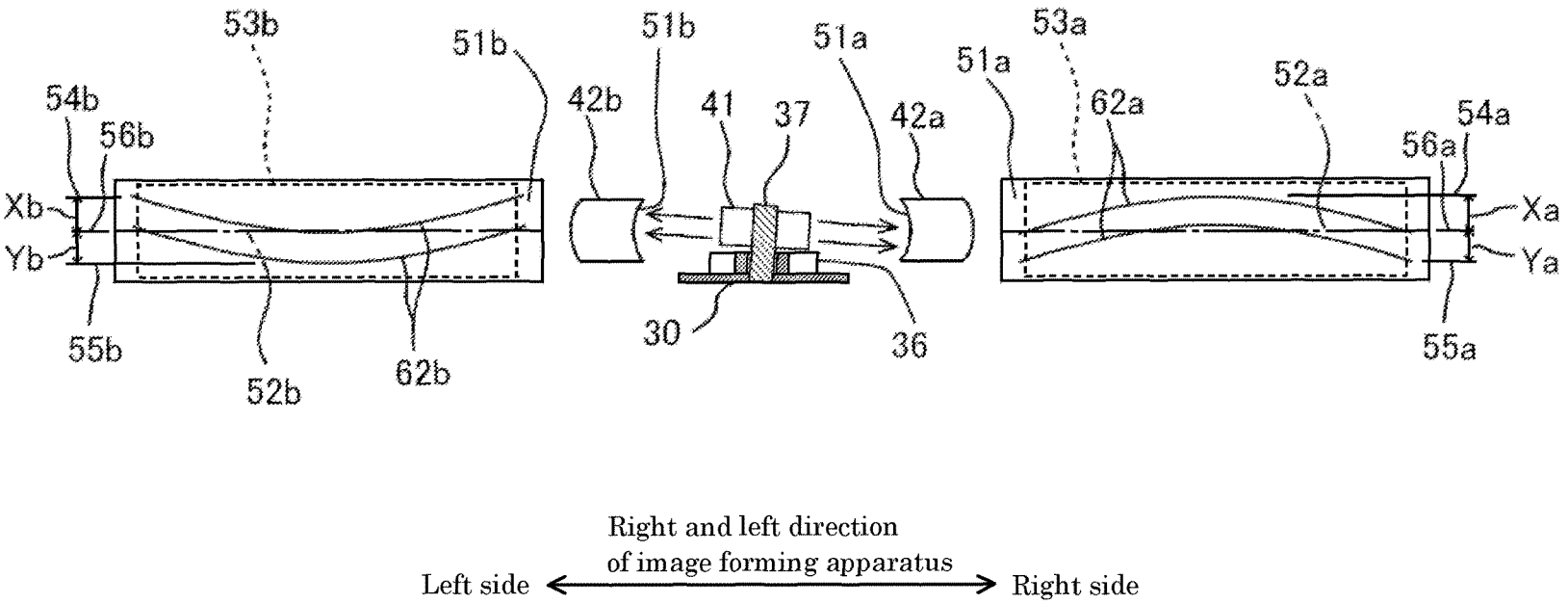
FIG. 7 is a view illustrating scanning lines of light beams on incident surfaces of image forming lenses after an adjustment step is performed in an optical scanning device according to a modification example of an embodiment.

The modification example of the embodiment will be described. FIG. 6 illustrates the scanning lines 62*a* and 62*b* of light beams on the incident surfaces 51*a* and 51*b* of the image forming lenses 42*a* and 42*b* before the adjusting step is performed in the optical scanning device 4 according to the modification example of the embodiment. FIG. 7 illustrates the scanning lines 62*a* and 62*b* of the light beams on the incident surfaces of the image forming lenses 42*a* and 42*b* after the adjusting step is performed in the optical scanning device 4 according to the modification example of the embodiment.

In the present modification example, each of the light source units 43*a* and 43*b* is configured by a multibeam light source that emits a plurality of beam lights. At a scanning target surface, scanning lines of the plurality of beams emitted from the light source units 43*a* and 43*b* are arranged spaced apart from each other in the sub-scanning direction. For example, when two light beams are emitted from one light source unit, since four light beams are emitted from the opposed scanning type optical scanning device 4, the number of optical scanning devices 4 is 1 in the image forming apparatus 1. In the optical scanning device 4, two light beams are mutually deviated in the height direction and are incident into the image forming lenses 42*a* and 42*b* as illustrated in FIG. 6.

In an adjustment step, a position of the uppermost side, through which a light beam deflected and scanned at the uppermost side of the aforementioned effective ranges 53*a* and 53*b* between the two light beams passes, is defined as the "uppermost position", a position of the lowermost side, through which a light beam deflected and scanned at the lowermost side of the aforementioned effective ranges 53*a* and 53*b* between the two light beams passes, is defined as the "lowermost position", and a center height is detected. As illustrated in FIG. 7, the center height is allowed to approximately coincide with the heights of the bus lines 52*a* and 52*b* of the image forming lenses 42*a* and 42*b* at the incident surfaces 51*a* and 51*b* of the pair of image forming lenses 42*a* and 42*b*.

Other Embodiments

In the aforementioned embodiment, the optical scanning device 4 is configured in an opposed scanning type; however, as the optical scanning device 4, it may be possible to use an optical scanning device in which the image forming lens 42 is arranged at only one side of the polygon mirror 41.

In the aforementioned embodiment, an example, the optical scanning device 4 is applied to a printer, has been described; however, the technology of the present disclosure is not limited thereto and the optical scanning device 4, for example, may be applied to a facsimile and a projector.

What is claimed is:

1. An adjustment method of an optical scanning device including a deflection unit that deflects and scans a light beam emitted from a light source in a main scanning direction and an image forming lens that extends along the main scanning direction and forms an image of the light beam deflected and scanned by the deflection unit on a scanning target surface, wherein an uppermost position at an incident surface of the image forming lens, through which a light beam being deflected and scanned passes, and a lowermost position at the incident surface of the image forming lens, through which a light beam being deflected and scanned passes, are detected in a height direction perpendicular to the main scanning direction in an effective range corresponding to a latent image formation target range on the scanning target surface, and a center height between the uppermost position and the lowermost position is allowed to approximately coincide with a height of a bus line of the image forming lens at the incident surface of the image forming lens.

2. The adjustment method of the optical scanning device of claim 1, wherein in the optical scanning device, a plurality of light beams are mutually deviated in a height direction and are incident into the image forming lens, the uppermost position is a position of an uppermost side, through which a light beam deflected and scanned at an uppermost side of the effective range between the plurality of light beams passes, and the lowermost position is a position of a lowermost side, through which a light beam deflected and scanned at a lowermost side of the effective range between the plurality of light beams passes.

3. The adjustment method of the optical scanning device of claim 1, wherein in the optical scanning device, a number of the image forming lens arranged on an optical path between the deflection unit and the scanning target surface is 1.

4. The adjustment method of the optical scanning device of claim 1, wherein the optical scanning device has an opposed scanning type in which a rotating polygon mirror is used as the deflection unit and a pair of image forming lenses are symmetrically arranged with the rotating polygon mirror as a center while facing each other in a plan view, a rotating shaft of the rotating polygon mirror is inclined to one side of the pair of image forming lenses, the pair of image forming lenses are mounted at an equal height in advance, and for only one of the pair of image forming lenses, a deviation amount of the center heights with respect to the height of the bus line is detected, and at respective incident surfaces of the pair of image forming lenses, the center heights are mutually and reversely deviated by the deviation amount, thereby allowing the center heights to approximately coincide with the height of the bus line.

5. The adjustment method of the optical scanning device of claim 4, wherein in the optical scanning device, an approximately rectangular board is provided such that a longitudinal direction is approximately parallel to a pair of scanning target surfaces corresponding to the pair of image forming lenses and the rotating polygon mirror is mounted at an approximately center in a short direction of the board.

6. An optical scanning device comprising:

a deflection unit that deflects and scans a light beam emitted from a light source in a main scanning direction; and an image forming lens that extends along the main scanning direction and forms an image of the light beam deflected and scanned by the deflection unit on a scanning target surface, wherein a center height between an uppermost position at an incident surface of the image forming lens, through which a light beam being deflected and scanned passes, and a lowermost position at the incident surface of the image forming lens, through which a light beam being deflected and scanned passes, is allowed to approximately coincide with a height of a bus line of the image forming lens in a height direction perpendicular to the main scanning direction in an effective range corresponding to a latent image formation target range on the scanning target surface.

7. The optical scanning device of claim 6, wherein a plurality of light beams are mutually deviated in a height direction and are incident into the image forming lens, the uppermost position is a position of an uppermost side, through which a light beam deflected and scanned at an uppermost side of the effective range between the plurality of light beams passes, and the lowermost position is a position of a lowermost side, through which a light beam deflected and scanned at a lowermost side of the effective range between the plurality of light beams passes.

8. The optical scanning device of claim 6, wherein a number of the image forming lens arranged on an optical path between the deflection unit and the scanning target surface is 1.

9. The optical scanning device of claim 6, wherein the optical scanning device is an opposed scanning type in which a rotating polygon mirror is used as the deflection unit and a pair of image forming lenses are symmetrically arranged with the rotating polygon mirror as a center while facing each other in a plan view, a rotating shaft of the rotating polygon mirror is inclined to one side of the pair of image forming lenses, and at respective incident surfaces of the pair of image forming lenses, the center height approximately coincides with the height of the bus line.

10. The optical scanning device of claim 9, further comprising:

an approximately rectangular board provided such that a longitudinal direction is approximately parallel to a pair of scanning target surfaces corresponding to the pair of image forming lenses, wherein the rotating polygon mirror is mounted at an approximately center in a short direction of the board.

11. An image forming apparatus comprising the optical scanning device of claim 6.

* * * * *